US006666326B2

(12) United States Patent
Hymes et al.

(10) Patent No.: US 6,666,326 B2
(45) Date of Patent: Dec. 23, 2003

(54) REINFORCED CHEMICAL MECHANICAL PLANARIZATION BELT

(75) Inventors: Diane J. Hymes, San Jose, CA (US); Jibing Lin, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/097,337

(22) Filed: Mar. 12, 2002

(65) Prior Publication Data

US 2003/0173193 A1 Sep. 18, 2003

(51) Int. Cl.[7] ..... B65G 15/30
(52) U.S. Cl. ..... 198/846; 198/847
(58) Field of Search ..... 198/846, 847

(56) References Cited

U.S. PATENT DOCUMENTS 3,871,946 A * 3/1975 Romanski et al. ..... 198/847 X
4,296,855 A * 10/1981 Blalock ..... 198/847
4,550,823 A * 11/1985 Gladish ..... 198/847 X
5,141,101 A * 8/1992 Vance et al. ..... 198/847
5,161,677 A * 11/1992 Beecher ..... 198/847
6,116,411 A * 9/2000 Reiner et al. ..... 198/847

* cited by examiner

*Primary Examiner*—James R. Bidwell
(74) *Attorney, Agent, or Firm*—Martine & Penilla, LLP

(57) ABSTRACT

A processing belt for use in chemical mechanical planarization (CMP), and methods for making the same, is provided. Embodiments of the processing belt include a mesh belt, and a polymeric material encasing the mesh belt to define the processing belt. The processing belt is fabricated so that the mesh belt forms a continuous loop within the polymeric material, and the mesh belt is constructed as a grid of intersecting members. The intersecting members are joined at fixed joints to form a rigid support structure for the processing belt.

24 Claims, 13 Drawing Sheets

REINFORCED CHEMICAL MECHANICAL PLANARIZATION BELT

BACKGROUND OF THE INVENTION

1. Field of the Invention

The present invention relates generally to wafer preparation belts, and more specifically to the fabrication of belt materials used in chemical mechanical planarization apparatus.

2. Description of the Related Art

In the fabrication of semiconductor devices, a plurality of layers are typically disposed over a substrate, and features are defined in and through the layers. A surface topography of the substrate or wafer can become irregular during fabrication processes, and an un-corrected irregularity increases with the addition of subsequent layers. Chemical Mechanical Planarization (CMP) has developed as a fabrication process utilized to planarize the surface of a semiconductor wafer, as well as to perform additional fabrication processes including polishing, buffing, substrate cleaning, etching processes, and the like.

In general, CMP processes involve the application of a substrate or wafer against a processing surface with a controlled pressure. Both the processing surface and the wafer are caused to rotate, spin, or otherwise move independently of one another to create a frictional force for planarization and to ensure the entire surface of the wafer is consistently and controllably processed. Typical CMP apparatus include linear belt processing systems in which a belt having a processing surface is supported between two or more drums or rollers which move the belt through a rotary path presenting a flat processing surface against which the wafer is applied. The wafer is typically supported and rotated by a wafer carrier, and a polishing platen is configured on the underside of the belt traveling in its circular path. The platen provides a stable surface over which the belt travels, and the wafer is applied to the processing surface of the belt against the stable surface provided by the platen. In some applications, abrasives in an aqueous solution known as slurry are introduced to facilitate and enhance the planarization or other CMP process.

Additional CMP apparatus include rotary CMP processing tools having a circular pad configuration for the processing surface, an orbital CMP processing tool similar to the circular CMP processing tool, a sub-aperture CMP processing tool, and other CMP processing systems providing a plurality of apparatus and configurations that, in general, utilize chemical and mechanical forces to planarize, scrub, polish, buff, clean, or otherwise process the surface of a semiconductor wafer having integrated circuits or other structures fabricated thereon.

In the linear belt CMP system, the belt and processing surface are typically fabricated to provide a stable structure to withstand the stresses of the belt and drum configuration, as well as a stable processing surface upon which precise and controllable planarization can occur. In addition to the stretching and contraction caused by the belt and processing surface traveling around the drums that drive the system, the belt and processing surface are typically in a wet environment from the liquid from slurry and rinsing operations. Belts and processing surfaces are typically constructed of a plurality of materials such as, by way of example, a stainless steel supporting layer, a cushioning layer, and one or more processing surface layers. The plurality of layers are joined by adhesives, bonding, stitching, and the like to form the continuous belt structure with an outwardly facing processing surface against which a wafer is applied in a CMP process.

The fabrication of linear belts in a plurality of layers as described provides the necessary support to substantially prevent the stretching of linear CMP belts, but adds manufacturing costs to belt construction, such belts can be difficult to work with, and such belts are subject to structural failure at openings for end point detection systems, and due to break down of the bond between layers caused by normal use and aggravated by the typically wet CMP environment.

Other examples of linear CMP belts include substantially polymer material without the additional layers described above, but the substantially polymer material belts tend to stretch and otherwise deform with continued use. Woven fabric has been added to some belts for rigidity, but woven fabric also allows some measure of stretch, can be difficult to work with, and does not provide for discontinuities in the fabric for end point detection openings without unraveling of the fabric if the discontinuities are fabricated prior to belt casting. If the discontinuities are desired to be fabricated in a woven fabric after casting, considerable time, effort, and expense are required to create the openings in a completed reinforced belt. Additionally, fabric is difficult to work with in belt casting, and lacking rigid structure or form, is difficult to position for fabrication.

Linear belts used in linear belt CMP systems can be costly to manufacture, and can be time consuming to replace. Replacement of linear belts requires down time for the CMP system resulting in decreased through put and increased manufacturing costs. Linear belts can be subject to such failures as delamination or separation of the layers due to such factors as the contraction and stretching forces during use, and the breakdown of adhesives or other bonding techniques over time and accelerated in the wet CMP environment.

In view of the foregoing, what is needed are methods, processes, and apparatus to fabricate a linear CMP processing belt that is resilient to the stresses of use, less likely to delaminate or otherwise separate, and economical and easy to manufacture.

SUMMARY OF THE INVENTION

Broadly speaking, the present invention fills these needs by providing a reinforced polymeric CMP processing belt having an inner mesh core. The present invention can be implemented in numerous ways, including as a process, an apparatus, a system, a device, or a method. Several embodiments of the present invention are described below.

In one embodiment, a processing belt for use in chemical mechanical planarization (CMP) is disclosed. The processing belt includes a mesh belt and a polymeric material encasing the mesh belt to define the processing belt to be used in CMP operations.

In another embodiment, a belt for use in chemical mechanical planarization (CMP) processing is disclosed. The belt includes a polymeric material being cast into a continuous loop to define the belt, and a continuous mesh core embedded in the polymeric material. The continuous mesh core is defined as a more rigid inner core of the polymeric material.

In still a further embodiment, a processing belt for use in chemical mechanical planarization (CMP) is disclosed. The processing belt includes a continuous loop reinforcing mesh and a polymeric material. The polymeric material encases the reinforcing mesh to define the processing belt to be used in CMP operations. The continuous loop reinforcing mesh is constructed of stainless steel as a matrix of intersecting members bonded at joints to form a rigid mesh structure.

In yet another embodiment, a method for fabricating a belt for use in chemical mechanical planarization (CMP) is disclosed. The method includes forming a belt-shaped mesh, and providing a mold configured to form a belt-shaped structure. The belt-shaped mesh is positioned in the mold and a polymeric material is formed in the mold. The polymeric material is formed around and through the belt-shaped mesh such that the belt-shaped mesh is encased in the polymeric material.

In an additional embodiment, a method for fabricating a belt for use in chemical mechanical planarization (CMP) is disclosed. The method includes forming a belt-shaped mesh. A mold is provided that is configured to form a belt-shaped structure. A first polymeric material is formed in the mold. The first polymeric material is formed within the mold to define a polymeric belt. The first polymeric material is then cured, and the belt-shaped mesh is positioned against an interior surface of the polymeric belt. A second polymeric material is applied around and through the belt-shaped mesh such that the belt-shaped mesh is encased between the first polymeric material and the second polymeric material. The first polymeric material and the second polymeric material are chemically bonded together.

The advantages of the present invention are numerous. One notable benefit and advantage of the invention is significantly increased lifetime of the polymeric CMP processing belt in the CMP process. Unlike a typical linear CMP processing belt of prior art, the inner mesh core of the present invention provides the necessary strength, support, and resilience without stacks of bonded layers subject to delamination or separation. The inner mesh core of the present invention is encased within the structure of the processing belt and is therefore integral to the belt structure. Polymeric material is cast around and through the inner mesh core, or sprayed over and through the inner mesh core, resulting in a CMP processing belt of significantly increased lifetime in the CMP process.

Another benefit is the lower cost and ease of manufacture. Unlike typical prior art processing belts, the present invention includes a single inner mesh core around which the polymeric mass of the polishing belt is cast. The plurality of layers, adhesives, stitches, or other bonding materials between the plurality of layers are eliminated without compromise of strength, support, and resilience.

An additional benefit is the ability to readily integrate embodiments of the present invention with optical end point detection apparatus. The inner mesh core of the present invention provides for easy fabrication of optical "windows" for use with end point detection apparatus, and without compromise of necessary strength, support, and resilience. Further, integration of optical end point detection structures does not increase the likelihood of delamination or separation, or decrease the useable life of the processing belt.

Yet another advantage and benefit is the plurality of options provided by the present invention for specific or specialty applications. Embodiments of the present invention can be easily implemented with preferential reinforcement according to specific circumstance or desired use.

Other advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements.

DETAILED DESCRIPTION OF THE PREFERRED EMBODIMENTS

An invention for a CMP processing belt and methods for making the same are disclosed. In preferred embodiments, the CMP processing belt includes a reinforcing mesh belt, and a polymeric material encasing the mesh belt to define the processing belt to be used in CMP operations.

In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1A:
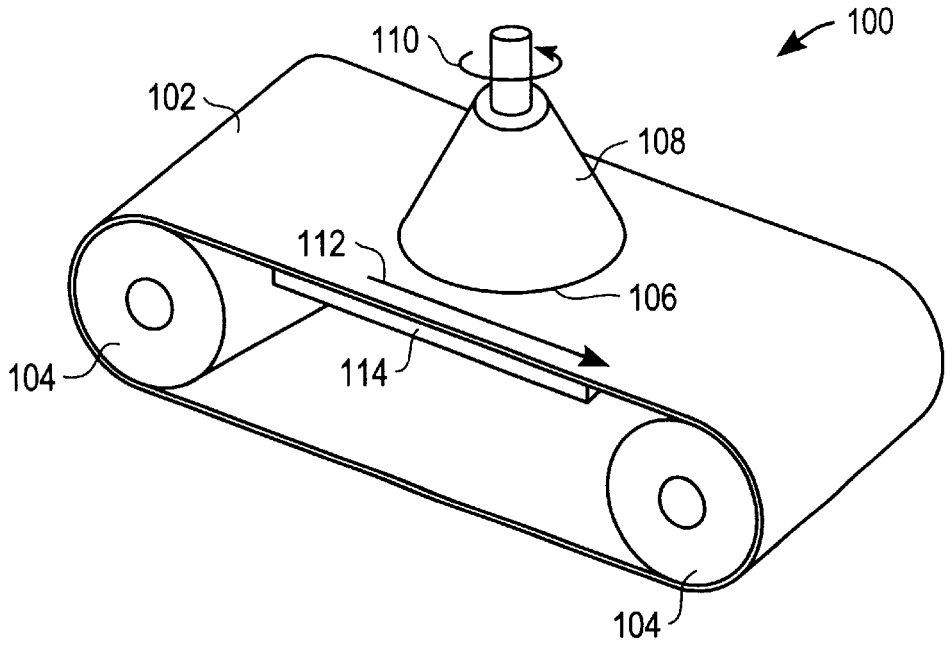
FIG. 1A illustrates a typical linear belt CMP system.
Figure 1B:
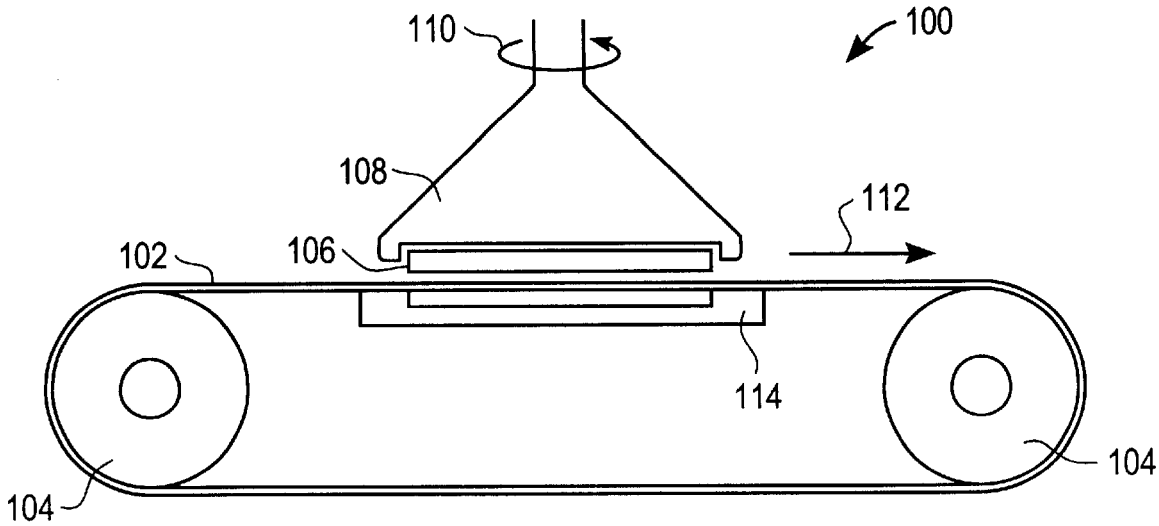
FIG. 1B shows a side view of the linear belt CMP system described in FIG. 1A.

FIG. 1A illustrates a typical linear belt CMP system 100. A linear CMP processing belt 102 is positioned around two drums 104. A wafer 106 for processing is attached to a wafer carrier 108 over the linear belt CMP system 100. The wafer carrier 108 is caused to rotate 110 which causes the wafer 106 to rotate, and the drums 104 rotate causing the linear CMP processing belt 102 to move in direction 112. The rotating wafer carrier 108 having a wafer 106 attached thereto is applied against the linear CMP processing belt 102 which is moving around drums 104 in direction 112. Platen 114 is positioned under linear CMP processing belt 102 opposite (e.g., on the opposite side of the linear CMP processing belt 102 from) the wafer carrier 108 with a wafer 106 attached. Platen 114 provides additional support in order for the wafer 106 to be applied against the linear CMP processing belt 102 with sufficient force to accomplish the desired planarization or other CMP process, as well as providing a flat surface for consistent, measurable processing. FIG. 1B shows a side view of the linear belt CMP system 100 just described.

As can be appreciated from FIGS. 1A and 1B, the linear CMP processing belt 102 is subjected to various stresses during operation of the linear belt CMP system 100. By way of example, as a point on the linear CMP processing belt 102 travels around drums 104, it is subjected to a stretching force, with the outer region of the linear CMP processing belt 102 subjected to greater stretching than the inner region of the linear CMP processing belt. As the point on the linear CMP processing belt continues travel off of and away from the drums 104, it is subjected to a contracting force as the belt straightens out and travels across the top or bottom of the linear belt CMP system 100 towards the next drum 104. Further, the linear belt CMP processing system 100 subjects the linear CMP processing belt 102 to processing stresses such as the downward force of the wafer against the processing surface, the frictional contact between the rotating wafer 106 and the linear CMP processing belt 102, and other such processing forces.

Figure 2A:
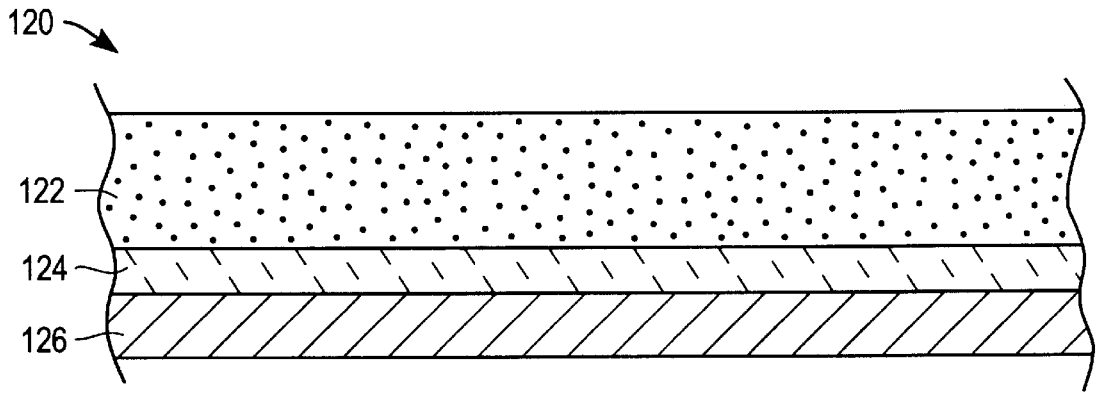
FIG. 2A shows a cross section of a typical linear CMP processing belt.

FIG. 2A shows a cross section of a typical linear CMP processing belt 120. The exemplary linear CMP processing belt 120 includes three layers 122, 124, and 126. The top polymeric layer 122 provides the processing surface against which the wafer 106 (see FIGS. 1A, 1B) is applied for CMP processing. A cushioning layer 124 is typically constructed between the processing surface polymeric layer 122 and the support or base layer 126, and provides a cushioning transition layer between the processing surface polymeric layer 124, and the rigid, hard support or base layer 126. Typically, the support or base layer 126 is a solid stainless steel or other similar metal belt or band over which has been fabricated the cushioning layer 124 and polymeric processing surface layer 122. The plurality of layers are typically joined by adhesives, casting of one layer over another, or other similar joining of one layer to the next.

Figure 2B:
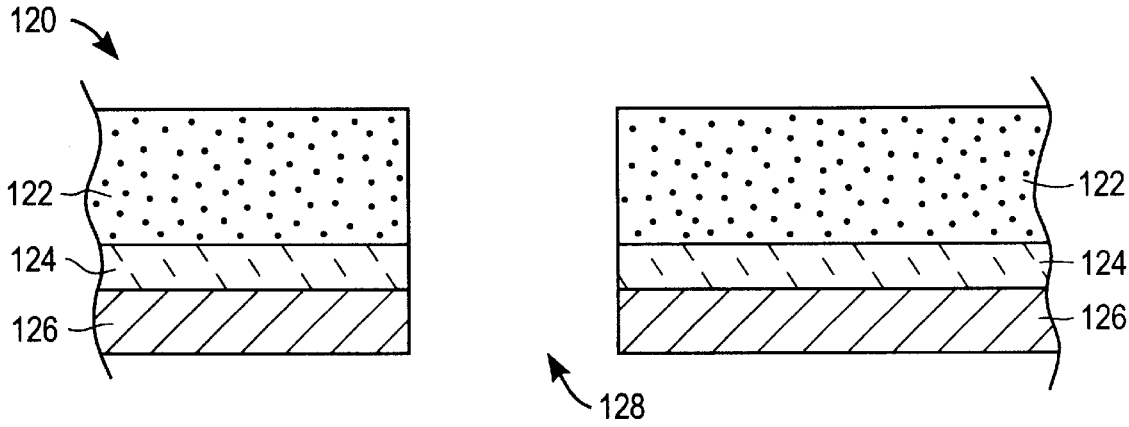
FIG. 2B shows the cross section of a typical linear CMP processing belt of FIG. 2A with an open section of belt for use with an in-situ optical end point detection system.

FIG. 2B shows the cross section of a typical linear CMP processing belt 120 of FIG. 2A with an open section 128 of belt for use with an in-situ optical end point detection (EPD) system. As can be appreciated in FIG. 2B, a section of the linear CMP processing belt 120 is removed, including the support or base layer 126, the cushioning layer 124, and the processing surface polymeric layer 122. When an open section 128 is constructed in a linear CMP processing belt 120, an open section 128 of sufficient size for optical EPD implementation is created in the linear processing belt 120. Typically, sufficient size includes a small circular, oval or square section of the linear CMP processing belt 120 that varies in size according to the particular processing tool with a typical dimension of about 1.25 inches in length and 0.75 inches in width, and therefore not an entire width of the linear CMP processing belt 120, or of such a large size as to significantly weaken the structural integrity of the linear CMP processing belt 120. Construction of the open section 128 for EPD use typically includes forming a hole or opening in the linear CMP processing belt 120 and through each of the processing surface polymeric layer 122, the cushioning layer 124, and the support or base layer 126.

As described above, the stretching and contracting forces caused during normal use of the linear CMP processing system 100 (see FIGS. 1A and 1B) can cause delamination or separation in a linear CMP processing belt 120 such as exemplary belt illustrated in FIG. 2A. The effects of the stresses of normal wear are aggravated by the wet environment including the use of slurries, rinses, and the like. Structures such as the open section 128 illustrated in FIG. 2A can increase the likelihood for linear CMP processing belt 120 to suffer structural failure including delamination or separation due to the increased surface area subjected to stress, increased likelihood of exposure of the layer joints and adhesives or other bonds to the wet environment, structural weakening of the base or support layer 126 from the opening or openings created, and the like.

Figure 3A:
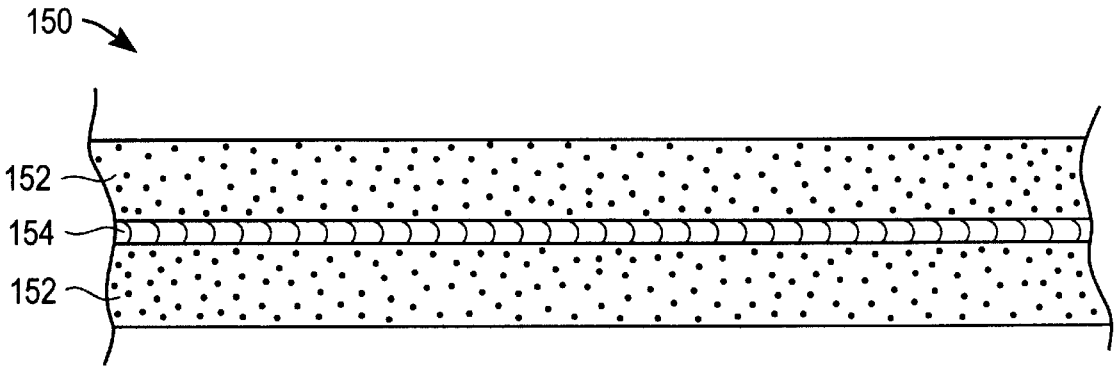
FIG. 3A is a cross section of a CMP processing belt in accordance with an embodiment of the present invention.

FIG. 3A is a cross section of a CMP processing belt 150 in accordance with an embodiment of the present invention. In the inventive CMP processing belt 150 shown in FIG. 3A, the CMP processing belt 150 is constructed substantially of polymeric 152 with a stainless steel or other suitable material mesh core 154. In one embodiment, the mesh core 154 forms an approximate core or center layer, and the polymeric 152 is cast around and through the mesh core 154. Examples of polymeric material used to cast the polymeric 152 of the CMP processing belt include polyurethanes, polyesters, PVC, polyacrylates, and epoxies. The resulting structure is flexible and resilient to withstand the stretching and contraction stresses of use in a linear belt CMP system 100 (see FIGS. 1A and 1B), is cast as a single, integrated structure and therefore not subject to a high likelihood for delamination or separation, provides a stable surface for CMP processing, is easily integrated with optical EPD systems, is durable and long-lasting, and provides a plurality of advantages over the prior art.

In one embodiment of the present invention, the mesh core 154 provides an internal support analogous to the base or support layer 126 described in reference to FIGS. 2A and 2B. As described herein, a mesh core of the CMP processing belt is defined as a continuous loop, belt-shaped inner core. The continuous loop has no beginning and no end, and therefore is a belt- or band-shaped structure. Unlike the solid base or support layer 126 of FIGS. 2A and 2B, the mesh core 154 of the present invention provides the desired strength and support as an inner core, and due to its mesh design, is bonded and cast within the polymeric 152 to substantially reduce or essentially eliminate the likelihood of delamination or other separation that can result when polymeric is bonded or otherwise cast to a solid base or support layer 126 as illustrated in FIGS. 2A and 2B.

Figure 3B:
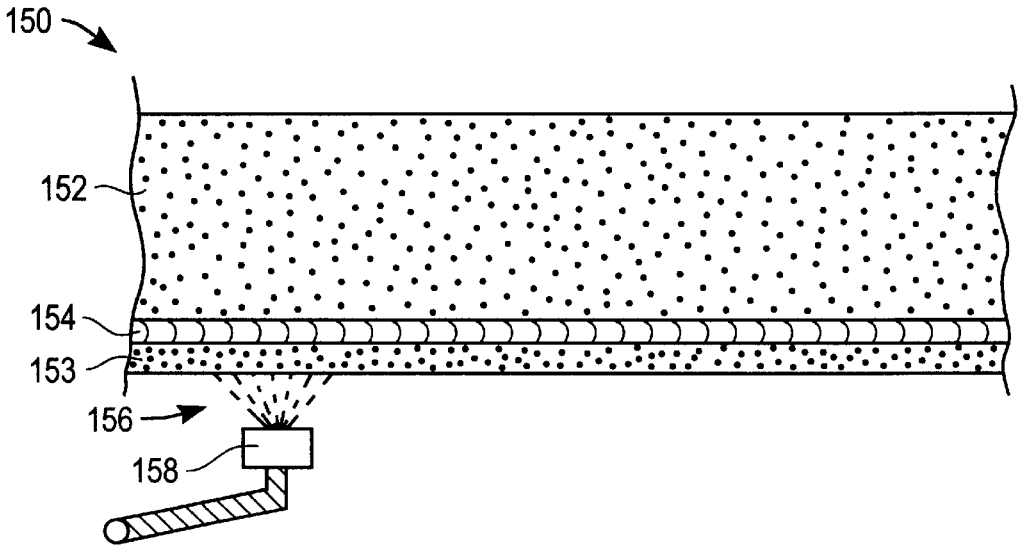
FIG. 3B is a cross section of a CMP processing belt in accordance with another embodiment of the present invention.

FIG. 3B is a cross section of a CMP processing belt 150 in accordance with another embodiment of the present invention. In the embodiment illustrated in FIG. 3B, the polymeric CMP processing belt 150 is reinforced with a mesh reinforcing layer 154. The mesh reinforcing layer 154 of FIG. 3B is the same structure as the mesh core 154 shown in FIG. 3A. The mesh reinforcing layer 154 is therefore a mesh layer of the CMP processing belt 150 having a continuous loop, belt-shaped structure. In one embodiment, the CMP processing belt 150 is essentially cast of polymeric 152, and the reinforcing mesh layer 154 is positioned against a bottom surface of the polymeric 152 material. The reinforcing mesh layer 154 is then bonded to the polymeric layer 152 by spraying 156 additional polymeric 153, essentially forming an additional polymeric layer 153 and resulting in the reinforcing mesh layer 154 being a mesh core 154. In one embodiment, the additional polymeric layer 153 is the same material as the polymeric layer 152. In another embodiment, the additional polymeric layer 153 is a different material than the polymeric layer 152, according to process requirements and desires.

In one embodiment of the invention, an applicator 158 is used to spray 156, or otherwise apply, polymeric to the reinforcing mesh layer 154 positioned against a CMP processing belt 150 that has been cast of polymeric 152. The additional polymeric 153 applied to the reinforcing mesh layer 154 and polymeric 152, in one embodiment, forms a continuous structure being of the same polymeric material as the polymeric layer 152 and flowing through and around the generally porous grid pattern of the reinforcing mesh layer 154.

Figure 3C:
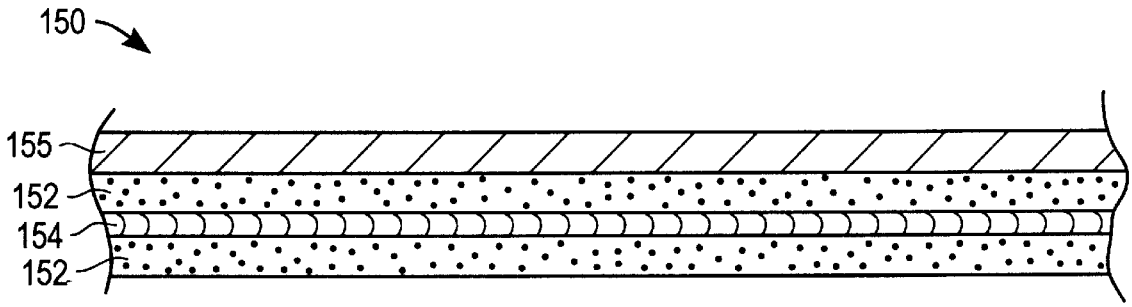
FIG. 3C is a cross section of a CMP processing belt in accordance with yet another embodiment of the present invention.

FIG. 3C is a cross section of a CMP processing belt 150 in accordance with yet another embodiment of the present invention. In the embodiment illustrated in FIG. 3C, the polymeric CMP processing belt 150 is reinforced with a mesh reinforcing layer 154. The mesh reinforcing layer 154 of FIG. 3C is the same structure as the mesh core 154 shown in FIGS. 3A and 3B. In the embodiment illustrated in FIG. 3C, the CMP processing belt 150 is essentially cast of polymeric 152 encasing the mesh core 154 similar to the CMP processing belt 150 illustrated in FIG. 3A. A processing surface layer 155 is then cast, in one embodiment, over the polymeric 152 encasing the mesh core 154. In another embodiment, the processing surface layer is sprayed on using an applicator as described above in reference to FIG. 3B. The CMP processing belt 150 illustrated in FIG. 3C can be utilized where processing conditions are optimized using materials in which the processing surface layer 155 is of a different hardness than polymeric layer 152. Both the processing surface layer 155 and the polymeric layer 152 can be of polymeric materials and therefore securely bonded. Additionally, when processing conditions warrant, processing surface layer 155 can be cast or otherwise applied and include one or more individual layers, only one of which is illustrated in FIG. 3C. A processing surface layer 155 consisting of more than a single layer of polymeric material can be used to implement differing hardness layers in a CMP processing belt 150 to achieve desired processing surface properties, for example, a cushioning layer beneath the process surface.

The embodiment of the CMP processing belt 150 illustrated in FIG. 3C can also be utilized to control the thickness of the CMP processing belt 150 to meet performance requirements. A typical CMP processing belt 150 in accordance with the present invention such as those illustrated in FIGS. 3A and 3B ranges from about 80 mils in thickness to about 100 mils in thickness. In the CMP processing belt illustrated in FIG. 3C, the thickness of the polymeric layer 152 with the embedded mesh core 154 can be minimized to a range of about 20 mil to about 30 mil while retaining the desired strength and structural support properties. The overall thickness of the CMP processing belt 150 is then dependent upon the type and thickness of the processing surface layer 155. If a thicker CMP processing belt is desired, the polymeric layer 152 with the embedded mesh core 154 can be made as thick as desired to achieve the desired thickness for the CMP processing belt.

Figure 4:
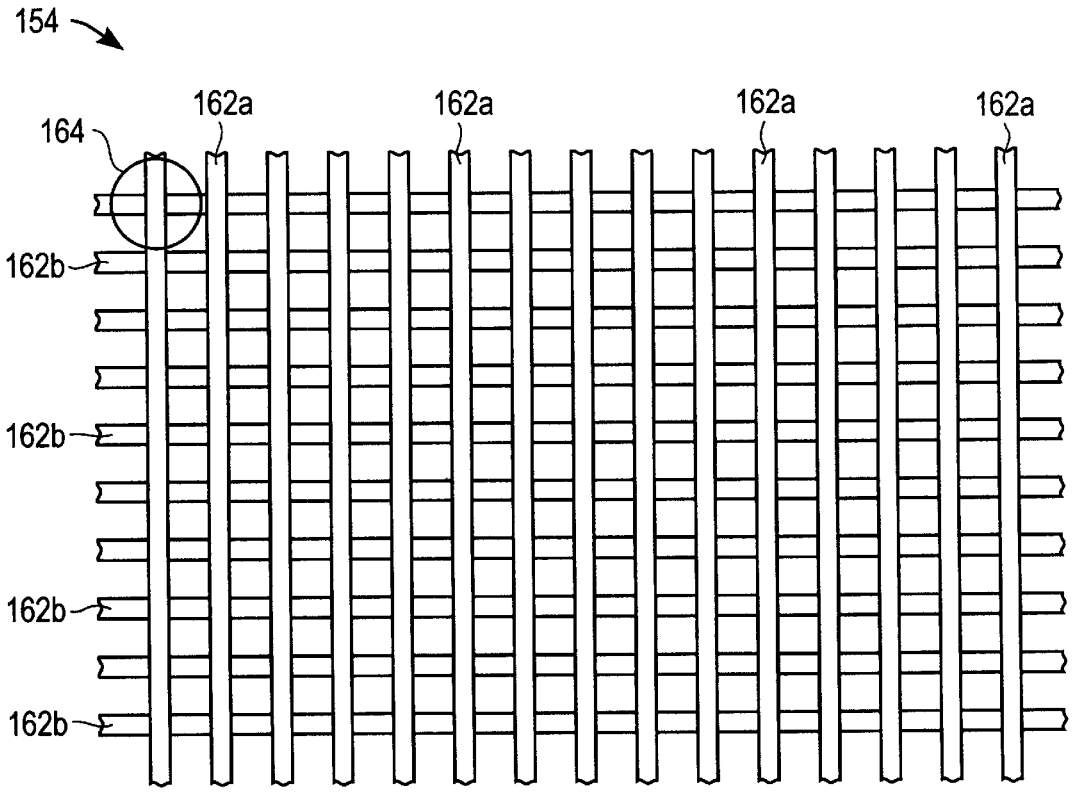
FIG. 4 shows a detailed view of a mesh core in accordance with one embodiment of the present invention.

FIG. 4 shows a detailed view of a mesh core 154 in accordance with one embodiment of the present invention. In the illustrated embodiment, the mesh core 154 is configured in a grid arrangement. As described herein, a grid defines the mesh structure of the inner mesh core 154, and a grid is alternatively defined as a matrix. Vertical members 162*a* and horizontal members 162*b* are arranged to form a perpendicular grid as illustrated. In one embodiment, the mesh core 154 is constructed by adhering, bonding, welding, soldering, or otherwise affixing the vertical members 162*a* and the horizontal members 162*b*. As will be described in greater detail in reference to FIGS. 5A and 5B, the mesh core 154 is not limited to vertical members 162*a* and horizontal members 162*b*, but grid members 162 (illustrated in FIG. 4 as 162*a* and 162*b*) which can be in any desired orientation or grid pattern according to the processing environment, desires, specifications, and the like.

Each joint 164 between grid members 162*a*, 162*b*, is fixed in one embodiment in order to allow for discontinuities in the grid as will be described in greater detail below in reference to FIGS. 6A and 6B. In another embodiment, the grid or matrix is constructed by weaving, braiding, intertwining, or otherwise forming a grid of inwoven members 162*a*, 162*b*.

In one embodiment, the vertical members 162*a* and the horizontal members 162*b* are cylindrical shafts or single strand wires constructed of stainless steel. Other materials from which the mesh core 154 can be constructed include stainless steel alloys, aluminum, steel, copper, and the like to provide a strong internal framework for the linear CMP processing belt 150 (see FIG. 3), that is resilient to the stresses caused by normal linear CMP processing, that is easily fabricated and encased in polymers and therefore not subject to delamination, and that provides a rigid structure that adequately supports the application of a wafer for CMP processing, provides a durable reinforced processing belt for sustained CMP tool operation, and is not subject to stretching or other deformation. The cylindrical shaft structure, similar to a single strand wire, shaft, or rod, is selected to provide the most resilient and strong or durable structure for use in constructing the mesh core 154. Other embodiments of the invention include the use of essentially rectangular-shaped shafts with flat faces and a thin profile providing a greater surface area for bonding at the joints between grid members 162*a*, 162*b*, or any other structure easily formed into the grid or matrix pattern of a mesh.

Figure 5A:
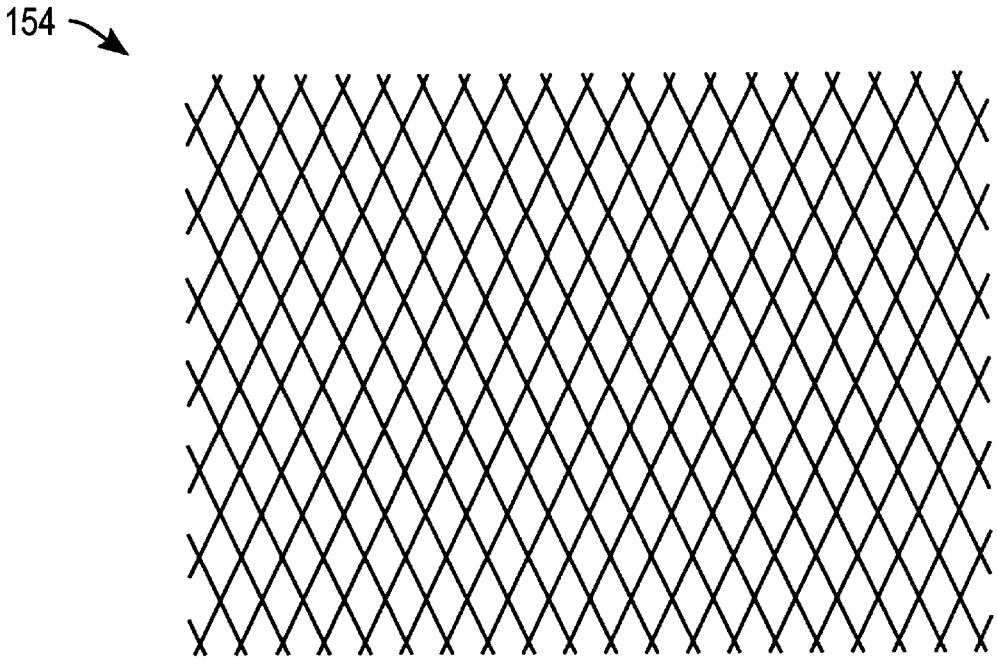
FIG. 5A shows the mesh core constructed in a simple cross- or diagonal-grid pattern.
Figure 5B:
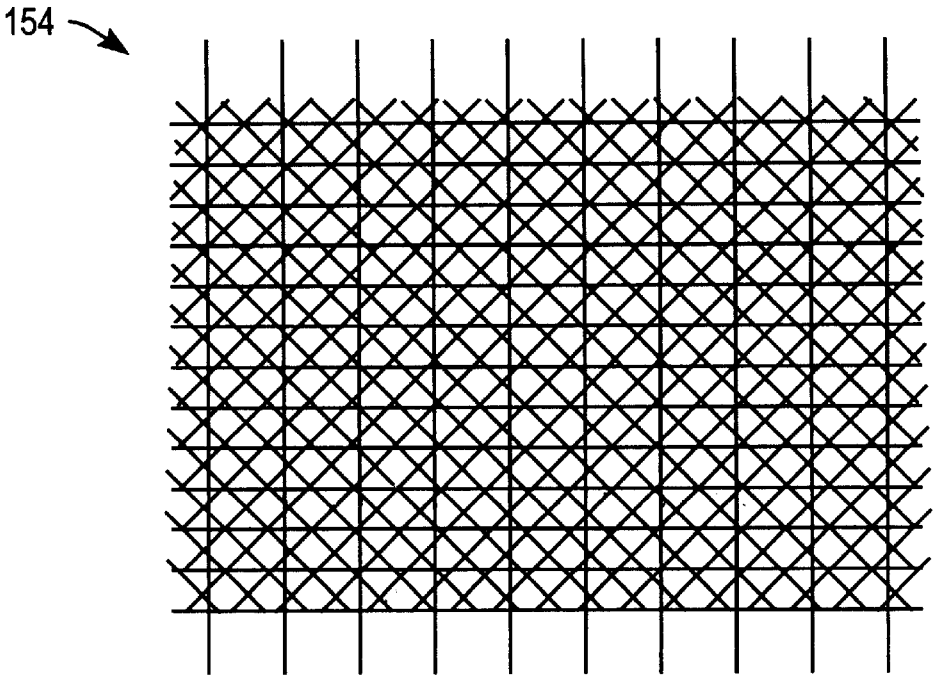
FIG. 5B shows the mesh core constructed in a combination of a perpendicular grid as illustrated in FIG. 4, and a cross- or diagonal-grid as illustrated in FIG. 5A.

FIGS. 5A and 5B show embodiments of the mesh core 154 constructed of alternative grid or matrix patterns. In FIG. 5A, the mesh core 154 is shown constructed in a simple cross- or diagonal-grid pattern. In FIG. 5B, the mesh core 154 is shown constructed in a combination of a perpendicular grid as illustrated in FIG. 4, and a cross- or diagonal-grid as illustrated in FIG. 5A. FIGS. 5A and 5B show only two alternative embodiments of a plurality of grid arrangements or configurations. It should be appreciated that the grid members 162 of the mesh core 154 can be arranged and configured for specific applications. By way of example, the mesh core 154 can be configured to provide additional cross-belt reinforcement, to provide additional belt reinforcement around the girth of the linear CMP processing belt, to provide edge reinforcement, or to provide specific, localized reinforcement or strengthening as desired. One example of specific, localized reinforcement is. described further in reference to FIG. 6B. The grid or matrix pattern alternatives provide a plurality of embodiments of the present invention to satisfy the requirements of a plurality of CMP processing applications.

Figure 6A:
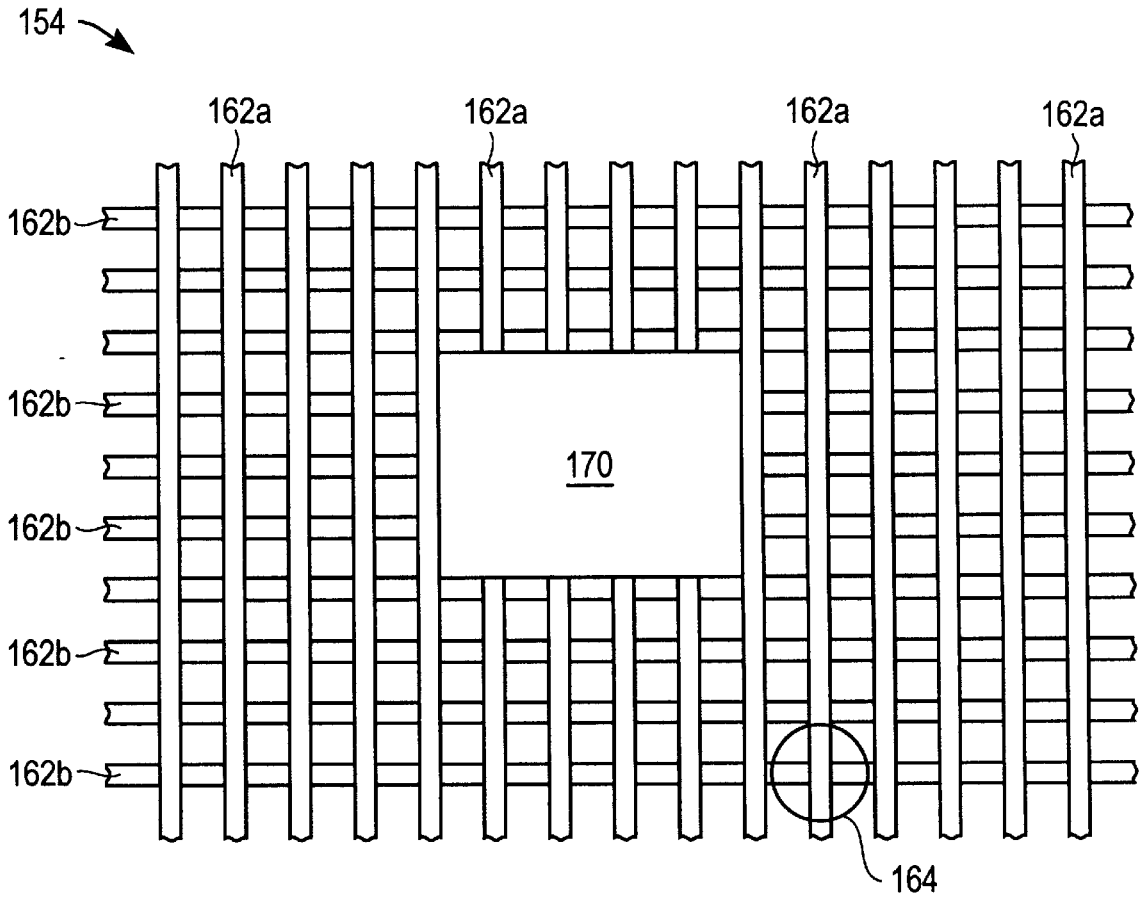
FIG. 6A illustrates a detailed view of a mesh core in accordance with one embodiment of the present invention.

FIG. 6A illustrates a detailed view of a mesh core 154 in accordance with one embodiment of the present invention. In the embodiment illustrated in FIG. 6A, an EPD opening 170 has been removed from the mesh core 154. As described above in reference to FIG. 4, embodiments of the mesh core 154 are constructed by adhering, bonding, welding, soldering, or otherwise affixing the vertical members 162*a* and the horizontal members 162*b*. Each joint 164 between grid members 162*a*, 162*b*, is fixed in order to allow for discontinuities in the grid. FIG. 6A illustrates an example of discontinuities in the grid of the mesh core 154. The grid member joints are fixed so that removal of one shaft from the fixed joint leaves the remaining three shafts, and the fixed joint, intact. As illustrated in FIG. 6A, an EPD opening 170 is constructed in the mesh core 154 by selectively severing a plurality of vertical members 162*a* and a plurality of horizontal members 162*b* adjacent to grid joints to form the EPD opening 170. Because the grid joints 164 are fixed, the mesh core 154 retains the desired strength, rigidity, flexibility, and resilience originally provided by the mesh core 154. The EPD opening 170 allows for optical EPD signals to be transmitted through the linear CMP processing belt 150 (see FIG. 3). The EPD opening 170 is shown in FIG. 6A in a shape easily constructed from the illustrated grid of mesh core 154. In a typical CMP processing belt 150, the shape of the EPD opening 170 is circular, oval, or square, and can be modified as appropriate to conform to a particular processing requirement. The illustrated EPD opening 170 is representative of any of a plurality of possible shapes.

Figure 6B:
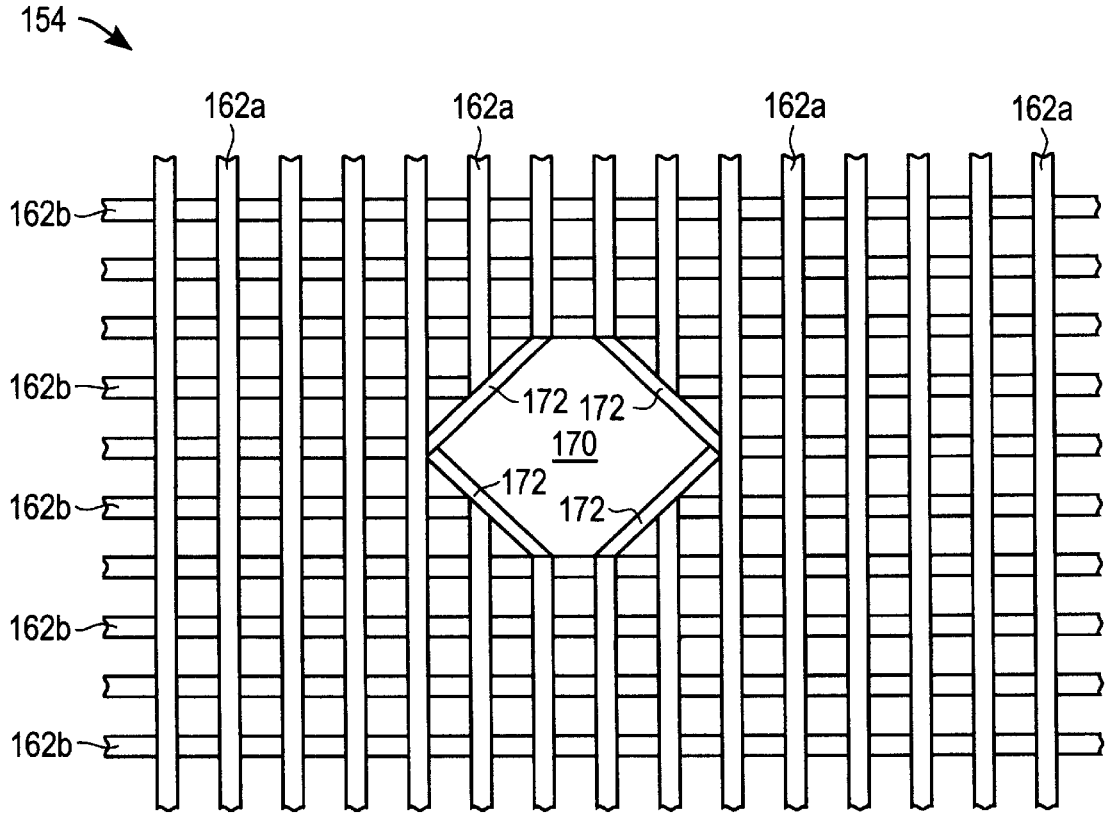
FIG. 6B illustrates a detailed view of a mesh core in accordance with another embodiment of the present invention.

FIG. 6B illustrates a detailed view of a mesh core 154 in accordance with another embodiment of the present invention. In FIG. 6B, an EPD opening 170 is constructed in mesh core 154. The EPD opening 170 is reinforced with supporting members 172 in the illustrated embodiment. Supporting members 172 can be fabricated and attached as desired to define a perimeter of EPD opening 170. In an embodiment of mesh core 154 in which the grid is constructed by weaving, braiding, or otherwise intertwining the grid members 162, an EPD opening 170 with supporting members 172 is particularly useful to prevent unraveling, stretching, or other deformity at the discontinuities in the grid. In one embodiment, supporting members are affixed at least at each grid joint around the perimeter of the EPD opening. The illustrated embodiment is one of a plurality of configurations and patterns for grid members 162. In another embodiment (not pictured) one or more circular supporting members 172 define the perimeter of the EPD opening 170, attached to the grid of the mesh core 154 at least at each adjacent grid joint.

Figure 7A:
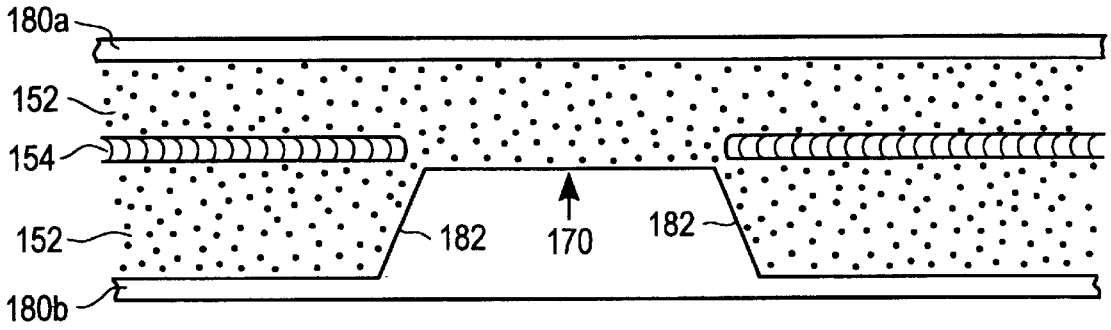
FIG. 7A shows a method of fabricating a CMP processing belt in accordance with one embodiment of the present invention.

FIG. 7A shows a method of fabricating a CMP processing belt in accordance with one embodiment of the present invention. FIG. 7A shows a section of a CMP processing belt being formed within a casting mold 180*a*, 180*b*, and including an EPD opening 170 in the mesh core 154. In one embodiment, mesh core 154 is positioned between a first side 180*a* and a second side 180*b* of a casting mold. In one embodiment, the EPD opening 170 is positioned adjacent to a feature 182 in the second side 180*b* of the casting mold to create a thinner region in the linear CMP processing belt at the EPD opening 170. Polymer precursor or liquid polymer is introduced into the casting mold to flow and form around the inner mesh core 154. The formation of a linear CMP processing belt using polymer and casting molds is described in greater detail below in reference to FIG. 8.

In one embodiment of the present invention, the feature 182 at the EPD opening 170 forms a thinner region of polymeric 152 surface at the EPD opening 170. In linear belt CMP systems 100 (see FIGS. 1A and 1B) implementing an optical EPD system, an optical beam is transmitted through the linear CMP processing belt. The EPD opening 170 allows for an optical beam to be transmitted through the mesh core 154. A plurality of polymers allow for limited optical transmission through the polymeric mass, and in one embodiment of the present invention, the thickness of the polymeric 152 mass is minimized to allow for optical transmission. Feature 182 provides for casting a thinner region of polymer 152 at the EPD opening 170. In an alternative embodiment, the first side 180*a* and the second side 180*b* of a casting mold have no feature 182, and the polymeric 152 surface at the EPD opening 170 is thinned, if necessary, after formation of the linear CMP processing belt. In still a further embodiment, the polymeric 152 mass is locally treated at the EPD opening 170 to clear the polymer 152. The locally cleared polymeric 152 region acts as a window through the EPD opening 170.

Figure 7B:
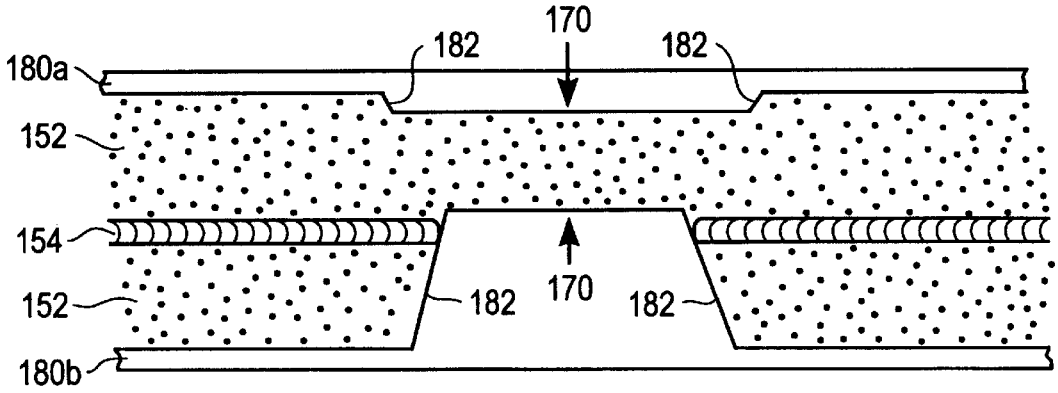
FIG. 7B shows another embodiment of the casting mold of the present invention.

FIG. 7B shows another embodiment of the casting mold 180*a*, 180*b* of the present invention. The first side 180*a* and the second side 180*b* of the casting mold illustrated in FIG. 7B each have a feature 182 positioned at the EPD opening 170. Feature 182 forms a thinner region of polymeric 152 mass at both top and bottom surfaces of the linear CMP processing belt. As described above in reference to FIG. 7A, the polymer 152 at the EPD opening 170 can additionally be treated to clear the polymeric 152 region, forming a window.

Figure 8:
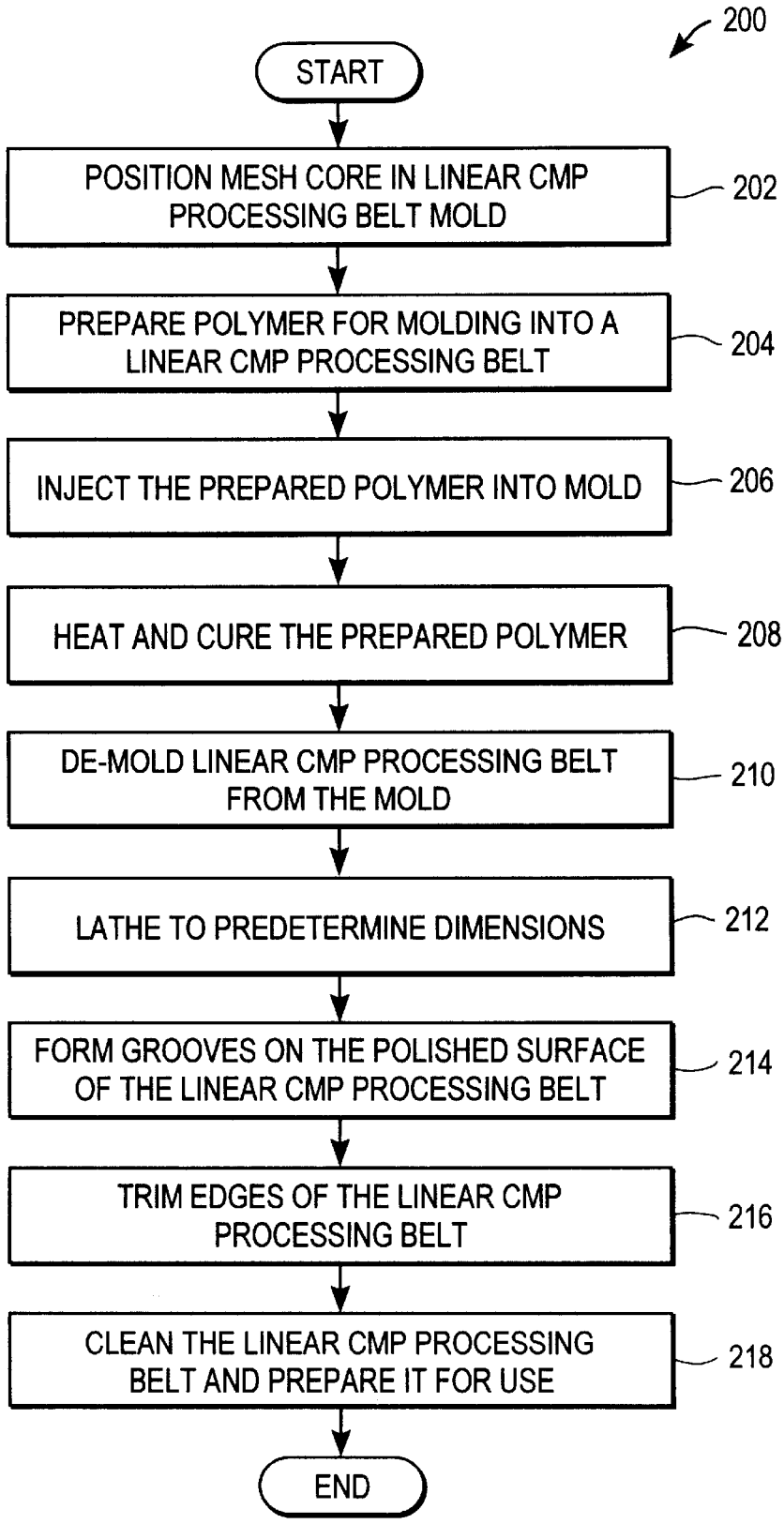
FIG. 8 is a flow chart diagram illustrating the method operations for manufacturing a CMP processing belt in accordance with one embodiment of the present invention.

FIG. 8 is a flow chart diagram 200 illustrating the method operations for manufacturing a polymeric linear CMP processing belt in accordance with one embodiment of the present invention. The illustrated method begins with operation 202 in which the mesh core for the polymeric linear CMP processing belt is positioned in the linear CMP processing belt mold. A linear CMP processing belt mold is described in greater detail below in reference to FIGS. 10A and 10B. In operation 202, the mesh core of the polymeric linear CMP processing belt, which may or may not include EPD openings as desired, is positioned within the mold to enable the casting of a polymer around and through the mesh core.

The method continues with operation 204 and the preparation of a polymer to be molded into a linear CMP processing belt. In one embodiment, a polymer material is prepared for molding into a polymeric linear CMP processing belt utilizing a completed polymeric molding container as described in more detail below in reference to FIGS. 10A and 10B. Any desired polymer may be used according to the intended processing requirements. Generally, a flexible, durable, and tough material is desired for a linear CMP processing belt for effective wafer planarization without scratching. The selected polymer need not be fully elastic, and should not slacken or loosen with use. Different polymers may be selected to enhance certain features of the intended process. In one embodiment, the polymer may be polyurethane. In another embodiment, the polymer may be a urethane mixture that produces a processing surface of the completed linear CMP processing belt that is a microcellular polyurethane with a specific gravity of approximately 0.4–1.5 g/cm$^2$ and a hardness of approximately 2.5–90 shore D. Typically, a liquid resin and a liquid curative are combined to form the polyurethane mixture. In another embodiment, a polymeric gel may be utilized to form the linear CMP processing belt.

After operation 204, the method proceeds to operation 206 in which the prepared polymer is injected into the mold. In one embodiment, urethane or other polymer or polymeric material is dispensed into a hot cylindrical mold. One embodiment of a cylindrical mold is described in greater detail below in reference to FIGS. 10A and 10B. It should be understood that other types and shapes of molds may be suitably used.

Then, in operation 208, the prepared polymer is heated and cured. It should be understood that any type of polymer may be heated and cured in any way that would produce the physical characteristics desired in a finished polymeric linear CMP processing belt. In one embodiment, a urethane mixture is heated and cured for a predetermined time at a predetermined temperature to form a urethane processing surface. Curing times and temperatures suitable to the selected polymer or polymeric material, or to achieve specific desired properties may be followed. In just one example, thermoplastic materials are processed hot and then become set by cooling.

After operation 208, the method advances to operation 210 and the polymeric linear CMP processing belt is de-molded by removing the belt from the mold. In one embodiment, the mold is a polymeric linear CMP processing belt molding container as described in further detail in reference to FIGS. 10A and 10B.

Then, in operation 212, the polymeric linear CMP processing belt is lathed to predetermined dimensions. In operation 212, the polymeric linear CMP processing belt is cut to the desired thickness and dimensions for optimal linear CMP processing. If the polymeric linear CMP processing belt is an embodiment with EPD openings, operation 212 includes the thinning and clearing of the polymeric regions at the EPD openings as described above. In one embodiment, the polymeric linear CMP processing belt is lathed to a thickness ranging from about 0.02 inch to about 0.2 inch, with a preferred thickness of about 0.09 inch, according to the CMP process for which the polymeric linear CMP processing belt is intended to be used.

After operation 212, the method proceeds to operation 214 and grooves are formed on a processing surface of the polymeric linear CMP processing belt in accordance with one embodiment of the invention. In another embodiment, the grooves may be formed during molding by providing a suitable pattern on the inside of the mold. In one embodiment, the raw casting is turned and grooved on a lathe to produce a smooth polishing surface with square shaped grooves.

After operation 214, the method advances to operation 216 in which the edges of the polymeric linear CMP processing belt are trimmed. Then, in operation 218 the polymeric linear CMP processing belt is cleaned and prepared for use. In one embodiment, the polymeric linear CMP processing belt is 90–110 inches in length, 8–16 inches wide and 0.020–0.2 inches thick. It is therefore suitable for use in the Teresa linear polishing apparatus manufactured by Lam Research Corporation. Once the polymeric linear CMP processing belt is prepared for use, the method is done.

Figure 9A:
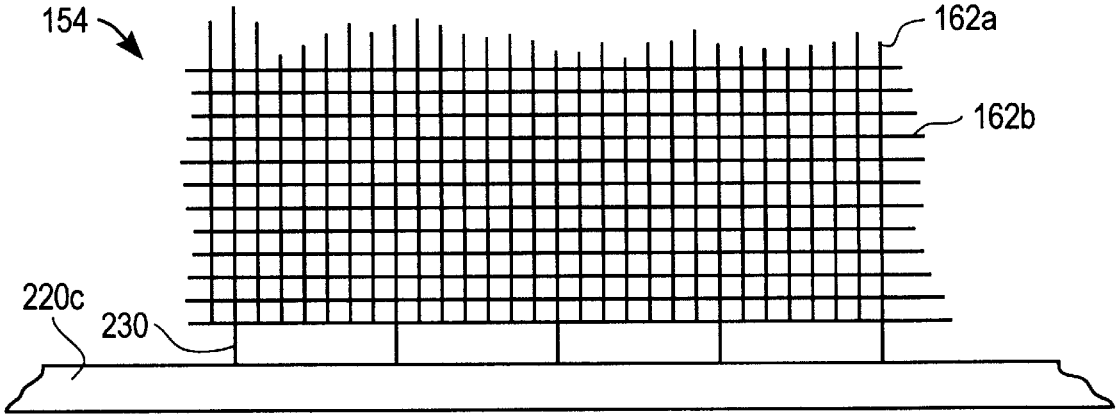
FIG. 9A illustrates a section of a mesh core as positioned within a linear CMP processing belt mold.

FIG. 9A illustrates a section of a mesh core 154 as positioned within a linear CMP processing belt mold (not shown). In one embodiment, the mesh core 154 is positioned within the mold in a track and on supports extending from a bottom track 220*c* of the mold. In another embodiment, vertical members 162*a* of the mesh core 154 are periodically extended to provide a support for the mesh core 154. The support for the mesh core 154 is provided to position the mesh core 154 within the mold (not shown) so that the polymeric linear CMP processing belt is cast around and through the mesh core 154 with a sufficient desired separation of the edge of the mesh core 154 and the edge of the finished polymeric linear CMP processing belt. It should be appreciated that the rigid structure of mesh core 154 allows for the placement and support of the mesh core 154 within the mold (not shown). The mesh core 154 is positioned on supports in one embodiment (see FIG. 9B), and in one embodiment is positioned on those vertical members 162*a* extended for the purpose of supporting the mesh core 154 within the mold. When positioned, the material properties of the mesh core 154 prevent sagging, bending, folding, and the like. In one embodiment, interior positioning pins (not shown) are provided for precise mesh core 154 positioning within the mold and, by way of example, adjacent to EPD openings.

Figure 9B:
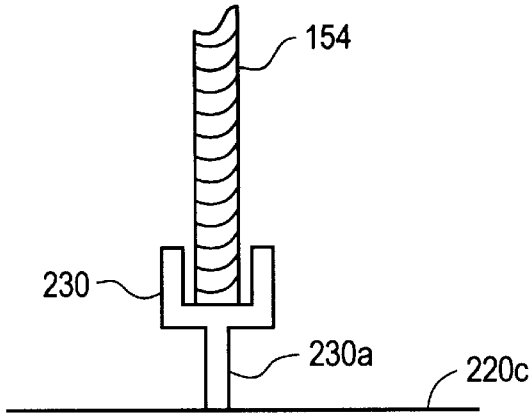
FIG. 9B illustrates a mesh core support positioning a mesh core in accordance with one embodiment of the invention.

FIG. 9B illustrates a mesh core support 230 positioning a mesh core 154 in accordance with one embodiment of the invention. In one embodiment, the mesh core support 230 extends from the bottom track of the mold (not shown) to position the mesh core 154 a desired distance from the edge of the finished polymeric linear CMP processing belt. In one embodiment, the stem 230*a* of the mesh core support 230 is constructed of a material having sufficient strength to support the mesh core 154 in position, to withstand the heat or any forces of polymer casting, and to easily break away from the bottom track 220*c* after the polymeric linear CMP processing belt is cast. Exemplary materials include soft or brittle metals and the like.

Figure 10A:
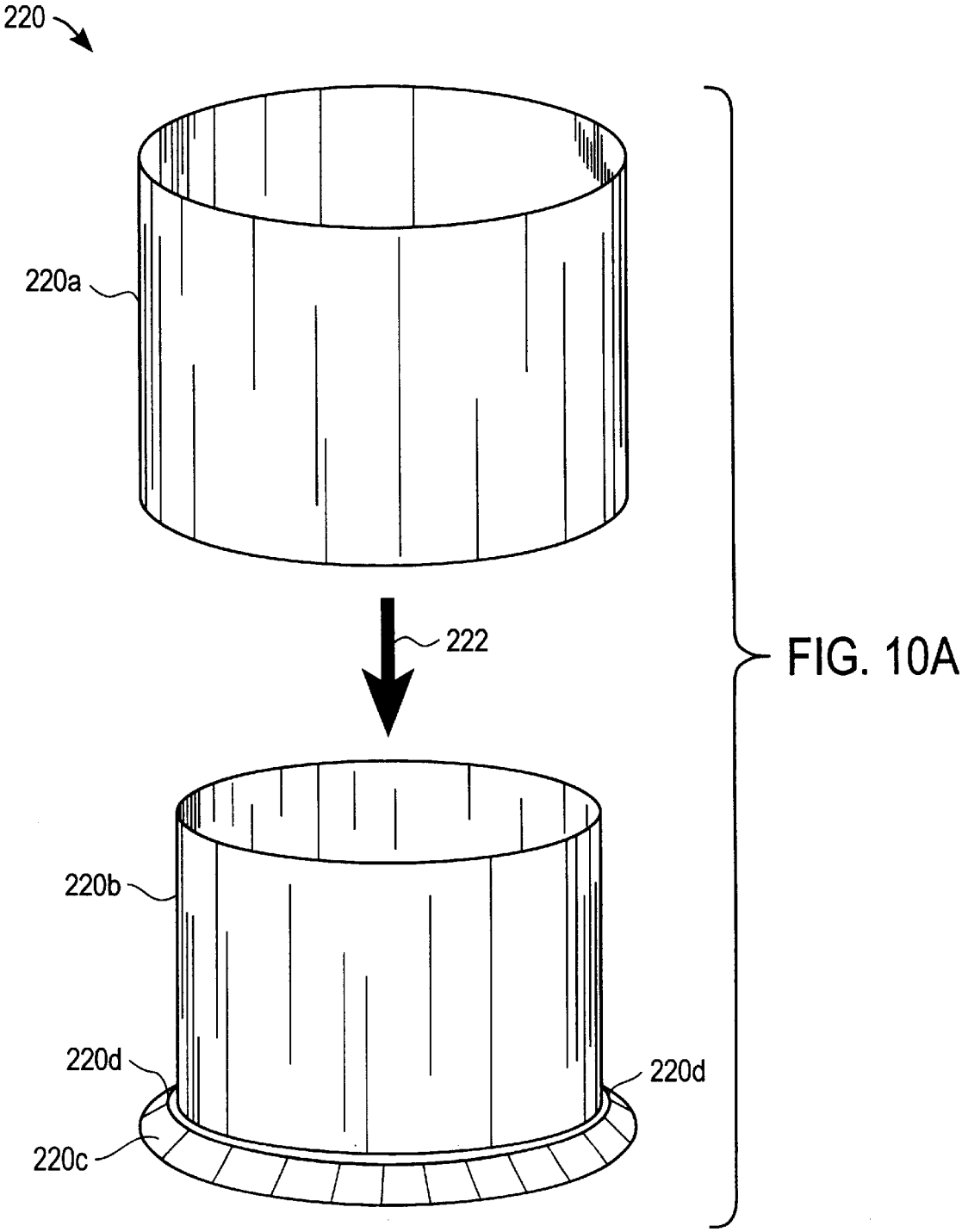
FIG. 10A illustrates a polymeric linear CMP processing belt mold in accordance with one embodiment of the present invention.
Figure 10B:
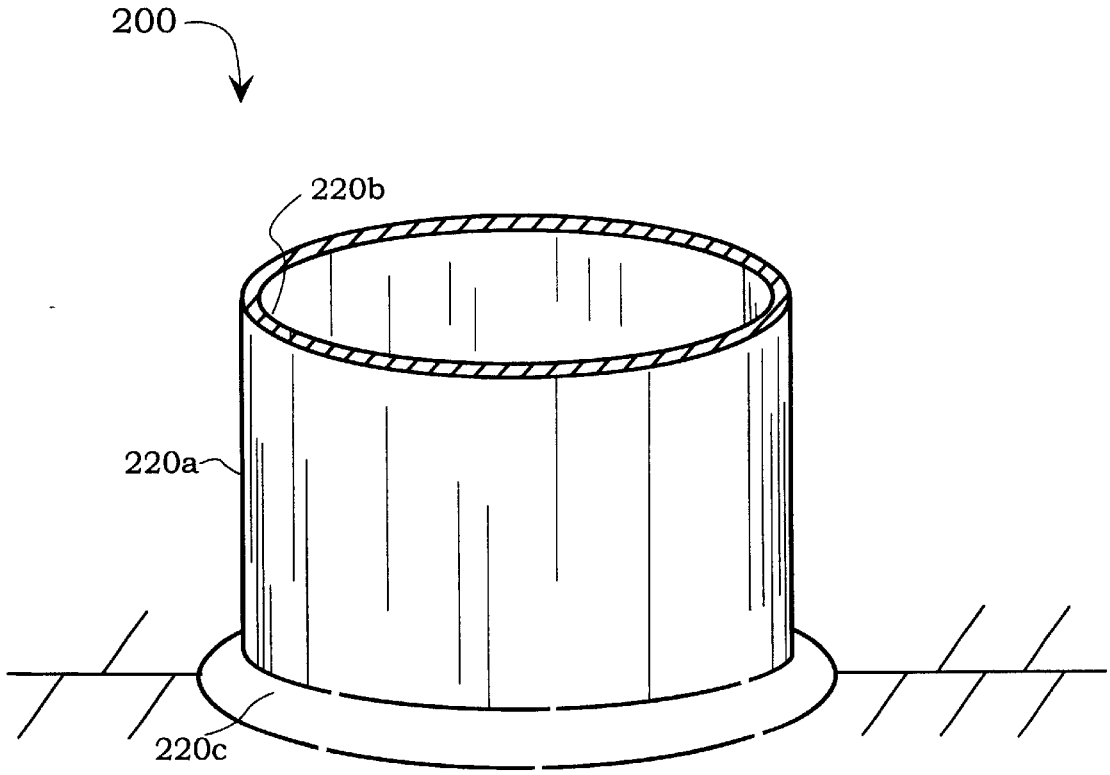
FIG. 10B illustrates a polymeric linear CMP processing belt mold in accordance with one embodiment of the present invention.

FIGS. 10A and 10B illustrate a polymeric linear CMP processing belt mold 220 in accordance with one embodiment of the present invention. In FIG. 10A, the mold 220 is shown separated to show a first side 220*a* and a second side 220*b* of the mold 220, as well as the bottom track 220*c*. A mesh core positioning track 220*d* is shown within bottom track 220*c*. The first side 220*a* and the second side 220*b* are assembled to be concentric, as shown by directional arrow 222, so that first side 220*a* defines a first surface of the resulting polymeric linear CMP processing belt, second side 220*b* defines a second surface of the resulting polymeric linear CMP processing belt, and bottom track 220*c* defines a third surface of the resulting polymeric linear CMP processing belt. In one embodiment, first side 220*a* defines a top surface of the resulting belt, second side 220*b* defines a bottom surface of the resulting belt, and bottom track 220*c* defines an edge of the resulting belt. Inner mesh core 154 (see FIG. 9A) is positioned between first side 220*a* and second side 220*b*, and is supported over bottom track 220*c*.

FIG. 10B shows an assembled polymeric linear CMP processing belt mold 220 into which an inner mesh core 154 (see FIG. 9A) can be positioned, and then liquid polymer or polymeric precursor can be flowed into the mold to form the polymeric linear CMP processing belt. As described in reference to FIG. 10A, in one embodiment the bottom track 220*c* defines an edge of the resulting polymeric linear CMP processing belt. In the formation of a polymeric belt, the polymeric material is flowed into the mold 220, in one embodiment, as a liquid polymer or polymeric precursor. The liquid polymer or polymeric precursor then fills the mold 220, flowing around and through the inner mesh core in accordance with one embodiment of the present invention. At the top of the mold, the surface of the liquid polymer or polymeric precursor then defines the second edge of the resulting polymeric linear CMP processing belt.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A belt for use in chemical mechanical planarization (CMP) processing, comprising:

a polymeric material being cast into a continuous loop to define the belt, a continuous mesh core embedded in the polymeric material, the continuous mesh core being defined as a rigid inner core of the polymeric material; and a processing surface defined over the polymeric material, the polymeric material being a first polymeric material and the processing surface being defined from a second polymeric material cast to the first polymeric material.

2. The belt of claim 1, wherein the polymeric material includes polyurethane, polyester, PVC, polyacrylate, and epoxy.

3. The belt of claim 1, wherein the continuous mesh core is defined as a grid of intersecting members, and the intersecting members are joined at fixed joints to form a rigid support structure for the belt.

4. The belt of claim 1, wherein the continuous mesh core is defined as a grid of intersecting members, and the intersecting members define a woven structure.

5. The belt of claim 3, further comprising discontinuities in the grid of the continuous mesh core, the discontinuities being configured to provide an opening in the grid suitable for optical transmissions through the grid.

6. The belt of claim 5, wherein the opening in the grid of the continuous mesh core is defined with reinforcing perimeter members, the perimeter members being affixed to the joints around the perimeter of the opening in the grid.

7. The belt of claim 5, wherein the polymeric material is made thinner at the opening in the grid of the continuous mesh core, and the polymeric material is treated to allow optical transmission through the thinner polymeric material at the opening in the grid of the continuous mesh core.

8. The belt of claim 1, wherein the continuous mesh core is defined from stainless steel.

9. A belt for use in chemical mechanical planarization (CMP) processing, comprising:

a polymeric material being cast into a continuous loop to define the belt; and a continuous mesh core embedded in the polymeric material, the continuous mesh core being defined as a rigid inner core of the polymeric material, wherein the polymeric material includes polyurethane, polyester, PVC, polyacrylate, and epoxy.

10. The belt of claim 9, wherein the continuous mesh core is defined from stainless steel.

11. The belt of claim 9, wherein the continuous mesh core is defined as a grid of intersecting members, and the intersecting members are joined at fixed joints to form a rigid support structure for the belt.

12. The belt of claim 9, wherein the continuous mesh core is defined as a grid of intersecting members, and the intersecting members define a woven structure.

13. The belt of claim 11, further comprising discontinuities in the grid of the continuous mesh core, the discontinuities being configured to provide an opening in the grid suitable for optical transmissions through the grid.

14. The belt of claim 13, wherein the opening in the grid of the continuous mesh core is defined with reinforcing perimeter members, the perimeter members being affixed to the joints around the perimeter of the opening in the grid.

15. The belt of claim 14, wherein the polymeric material is made thinner at the opening in the grid of the continuous mesh core, and the polymeric material is treated to allow optical transmission through the thinner polymeric material at the opening in the grid of the continuous mesh core.

16. A processing belt for use in chemical mechanical planarization (CMP), comprising:

a mesh belt; and a polymeric material encasing the mesh belt to define the processing belt to be used in CMP operations, wherein the mesh belt forms a continuous loop within the polymeric material, the mesh belt being constructed as a grid of intersecting members, and the intersecting members having discontinuities defined in the grid to provide an opening in the grid suitable for optical transmissions through the grid.

17. The processing belt of claim 16, wherein the discontinuities are reinforced with perimeter supporting members.

18. The processing belt of claim 16, wherein the polymeric material is made thinner at the opening in the grid of the mesh.

19. The processing belt of claim 16, wherein the polymeric material is treated to allow optical transmission through the polymeric material at the opening in the grid of the mesh.

20. The processing belt of claim 16, wherein the mesh belt is defined of stainless steel.

21. A processing belt for use in chemical mechanical planarization (CMP), comprising:

a continuous loop reinforcing mesh; and a polymeric material encasing the reinforcing mesh to define the processing belt to be used in CMP operations, wherein the continuous loop reinforcing mesh is defined from stainless steel in a matrix of intersecting members bonded at joints to define a rigid mesh structure, and the polymeric material encasing the reinforcing mesh to define the processing belt defines a processing surface to facilitate planarization in CMP operations.

22. The processing belt of claim 21, wherein the matrix of intersecting members includes discontinuities that form openings in the matrix and allow optical transmission to pass through the matrix.

23. The processing belt of claim 22, wherein the openings in the matrix are reinforced with perimeter supporting members.

24. The processing belt of claim 23, wherein the polymeric material encasing the reinforcing mesh is thinner at the openings in the matrix than the polymeric material encasing the reinforcing mesh in regions other than at the openings in the matrix.

* * * * *